US006676830B1

(12) United States Patent
Vichailak et al.

(10) Patent No.: US 6,676,830 B1
(45) Date of Patent: Jan. 13, 2004

(54) PROCESS FOR THE DESULFURIZATION OF A LIGHT FCC NAPHTHA

(75) Inventors: Montri Vichailak, Sugar Land, TX (US); Bertrand Klussman, Houston, TX (US); Mario J. Maraschino, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 90 days.

(21) Appl. No.: 09/953,801

(22) Filed: Sep. 17, 2001

(51) Int. Cl.[7] ..... C10G 45/00

(52) U.S. Cl. ..... 208/210; 208/213; 208/208 R; 208/209; 208/211; 208/217; 585/834; 585/841; 585/850; 585/867

(58) Field of Search ..... 208/213, 208 R, 208/209, 210, 211, 217; 585/834, 841, 850, 867

(56) References Cited

U.S. PATENT DOCUMENTS

| | | | | |
|---|---|---|---|---|
| 5,510,568 A | | 4/1996 | Hearn | 585/834 |
| 5,595,634 A | | 1/1997 | Hearn et al. | 203/29 |
| 5,597,476 A | | 1/1997 | Hearn et al. | 208/208 |
| 5,779,883 A | | 7/1998 | Hearn et al. | 208/213 |
| 5,807,477 A | | 9/1998 | Hearn et al. | 208/238 |
| 6,083,378 A | | 7/2000 | Gildert et al. | 208/209 |
| 6,231,752 B1 | | 5/2001 | Putman | 208/213 |
| 6,495,030 B1 | * | 12/2002 | Podrebarac | 208/218 |
| 6,592,750 B2 | * | 7/2003 | Podrebarac et al. | 208/210 |

* cited by examiner

*Primary Examiner*—Walter D. Griffin
*Assistant Examiner*—James Arnold, Jr.
(74) *Attorney, Agent, or Firm*—Kenneth H. Johnson

(57) ABSTRACT

A process for the desulfurization of a light boiling range ($C_5$-350° F.) fluid catalytically cracked naphtha, which may be first subjected to a thioetherification to react the diolefins with mercaptans contained in it to form sulfides, is fed to a high pressure (>250 psig) catalytic distillation hydrodesulfurization step along with hydrogen under conditions to react most of the organic sulfur compounds, including sulfides from the thioetherification to form $H_2S$. The $H_2S$ and a light product stream ($C_5$'s and $C_6$'s) are removed as overheads. The bottoms from the catalytic distillation hydrodesulfurization step is fractionated and the bottoms from the fractionation contacted with hydrogen in a straight pass hydrogenation step in the presence of a hydrodesulfurization catalyst at pressure of >250 and temperature >400° F. to further reduce the sulfur content.

10 Claims, 3 Drawing Sheets

PROCESS FOR THE DESULFURIZATION OF A LIGHT FCC NAPHTHA

BACKGROUND OF THE INVENTION

1. Field of the Invention

The present invention relates to a process for the desulfurization of a light boiling range ($C_5$-350° F.) naphthas, such as fluid catalytic cracked naphtha. More particularly the present invention employs a combination of steps which include catalytic distillation to reduce sulfur to very low levels, makes more efficient use of hydrogen and causes less olefin hydrogenation for a full boiling range naphtha stream.

2. Related Information

Petroleum distillate streams contain a variety of organic chemical components. Generally the streams are defined by their boiling ranges which determine the composition. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycylic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations. Environmental concerns suggests that the sulfur of the final product should be below 50 wppm.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical naphtha HDS unit:

$$RSH+H_2 \rightarrow RH+H_2S \quad (1)$$

$$RCI+H_2 \rightarrow RH+HCI \quad (2)$$

$$RN+2H_2 \rightarrow RH+NH_3 \quad (3)$$

$$ROOH+2H_2 \rightarrow RH+2H_2O \quad (4)$$

Typical operating conditions for the naphtha HDS reactions are:

| | |
|---|---|
| Temperature, ° F. | 500–650 |
| Pressure, psig | 300–800 |
| $H_2$ recycle rate, SCF/bbl | 300–3000 |
| Fresh $H_2$ makeup, SCF/bbl | 100–400 |

After the hydrotreating is complete, the product may be fractionated or simply flashed to release the hydrogen sulfide and collect the now desulfurized naphtha. The loss of olefins by incidental hydrogenation is detrimental by the reduction of the octane rating of the naphtha and the reduction in the pool of olefins for other uses.

In addition to supplying high octane blending components, the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction, the most common solution has been prefractionation prior to hydrotreating. The prefractionation produces a light boiling range naphtha which boils in the range of $C_5$ to about 250° F. and a heavy boiling range naphtha which boils in the range of from about 250–475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans, the mercaptans are converted to the corresponding disulfides.

U.S. Pat. No. 5,597,476 discloses a two step process in which naphtha is fed to a first distillation column reactor which acts as a depentanizer or dehexanizer with the lighter material containing most of the olefins and mercaptans being boiled up into a first distillation reaction zone where the mercaptans are reacted with diolefins to form sulfides which are removed in the bottoms along with any higher boiling sulfur compounds. The bottoms are subjected to hydrodesulfurization in a second distillation column reactor where the sulfur compounds are converted to $H_2S$ and removed.

In a catalytic distillation column reactor, the reaction temperature is limited by the boiling point of the material in the catalyst bed which is a function of the boiling range of the naphtha and the pressure in the reactor, which may require using higher pressures than desired to obtain the necessary reaction temperatures of desulfurizing light naphtha.

SUMMARY OF THE INVENTION

The present process is particularly useful for desulfurizing light naphtha. The central elements of the process comprise a catalytic distillation hydrodesulfurization step in combination with a distillation step and a straight pass hydrogenation step. In the catalytic distillation hydrodesulfurization step mercaptans in the feed are contacted with hydrogen in the presence of hydrodesulfurization catalyst preferably at pressure of >250 psig and fractionated into a first overheads and a first bottoms. In the distillation step the first bottoms are fractionated into a second overheads and a second bottoms. In the straight pass hydrogenation step the second bottoms is contacted with hydrogen in the presence of a hydrodesulfurization catalyst at pressure of >250 and temperature >400° F. to further reduce the sulfur content. The light naphtha feed is composed primarily of $C_4$–$C_{10}$ hydrocarbons (typically $C_5$-350° F.) which contain mercaptans and diolefins in amounts generally less than 1000 ppm before processing. The sulfur compounds are treated in the straight pass hydrogenation to extinction (<50 ppm).

Briefly the present process comprising:

a. feeding a naphtha stream containing diolefins and organic sulfur compounds comprising mercaptans to a reaction distillation zone;

b. concurrently in said reaction distillation zone:

i. contacting said naphtha feed with hydrogen in the presence of a hydrodesulfurization catalyst, preferably at a pressure of >250 psig, to produce a reaction mixture containing $H_2S$ and ii. fractionating said reaction mixture into a first overheads containing $H_2S$ and a naphtha fraction of less than $C_8$ and a first bottoms of a $C_6$+ naphtha fraction and organic sulfur compounds boiling in the range of the $C_6$+ naphtha fraction;

c. fractionating the first bottoms into a second overheads containing a $C_6$–$C_7$ naphtha fraction and a second bottoms containing a $C_7$+ naphtha fraction and sulfur compounds boiling in the range of the $C_7$+ naphtha fraction; and d. contacting the second bottoms with hydrogen in the presence of a hydrodesulfurization catalyst in a hydrodesulfurization zone, preferably at a pressure of >250 and a temperature >400° F., to further reduce the sulfur content.

In other embodiments the naphtha, without prior treatment to remove diolefins and mercaptans, is fed directly to the catalytic distillation hydrodesulfurization step. In these embodiments the overheads are a wider cut, e.g., $C_5$–$C_7$, and include diolefins and mercaptans which are reacted in a catalytic distillation thioetherification (CDTE) step. The bottoms from the CDTE step containing sulfides are returned to catalytic distillation hydrodesulfurization step and the $C_5$–$C_6$ product is recovered as a side draw from the CDTE step, the overheads being primarily $H_2S$ and $H_2$.

In other embodiments the naphtha, without prior treatment to remove diolefins and mercaptans, is fed directly to the catalytic distillation hydrodesulfurization step. In these embodiments the overheads are a wider cut, e.g., C5–C7, and include diolefins and mercaptans which are reacted in a catalytic distillation thioetherification (CDTE) step. The bottoms from the CDTE step containing sulfides are returned to catalytic distillation hydrodesulfurization step and the $C_5$–$C_6$ product is recovered as a side draw from the CDTE step, the overheads being primarily $H_2S$ and $H_2$.

As used herein the term "distillation column reactor" means a distillation column which also contains catalyst such that reaction and distillation are going on concurrently in the column (in a reaction distillation zone). In a preferred embodiment the catalyst is prepared as a distillation structure and serves as both the catalyst and distillation structure.

DETAILED DESCRIPTION OF THE INVENTION

Figure 1:
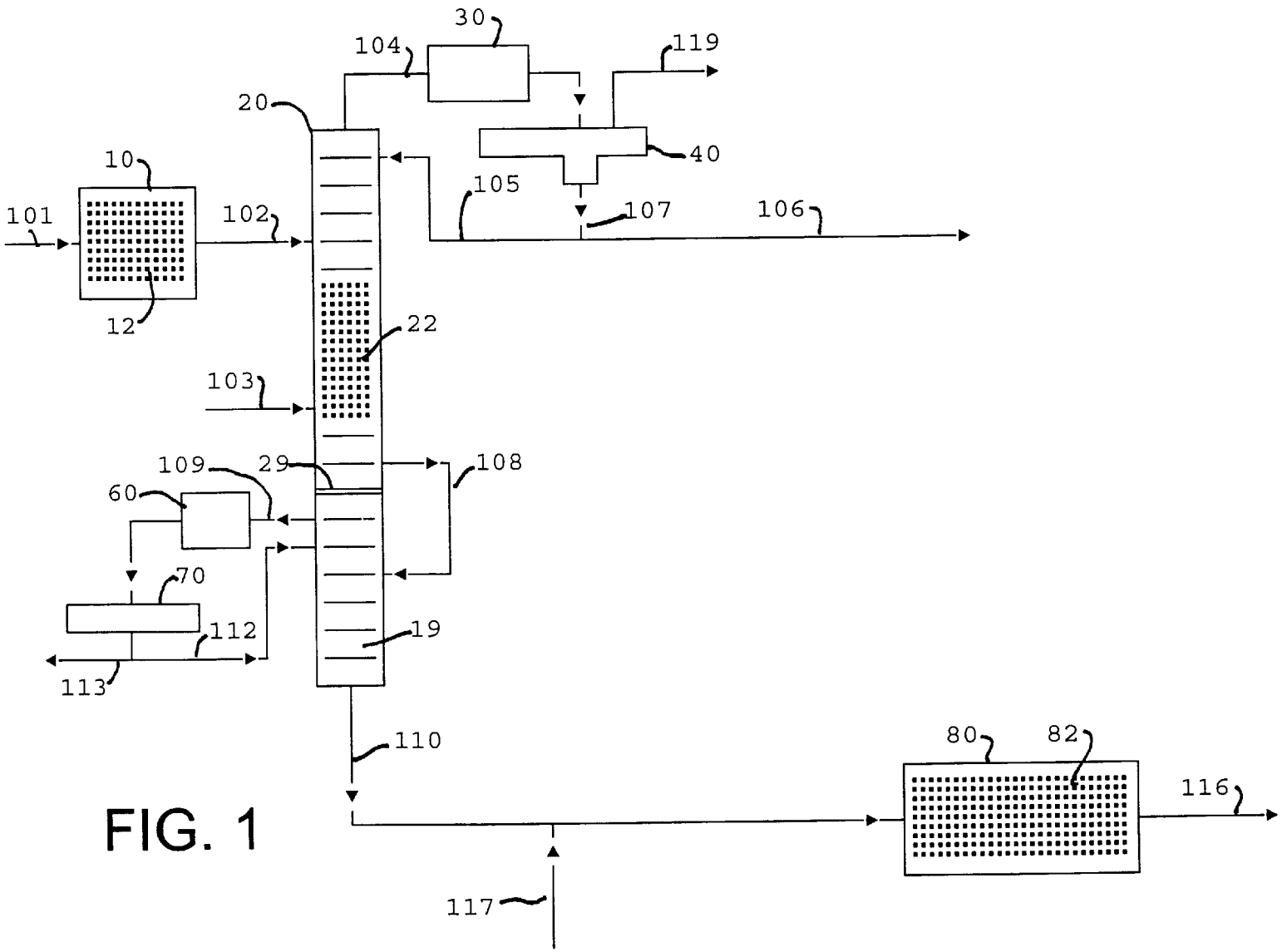
FIG. 1 is a flow diagram in schematic form of one embodiment of the present invention.

The feed to the process comprises a sulfur-containing petroleum fraction from a fluidized bed catalytic cracking unit (FCCU) which boils in the gasoline boiling range ($C_5$ to 350° F. or light cracked naphtha). Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and some dialkylsulfides. Typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and disulfides.

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

The lower boiling portion of the naphtha which contains most of the olefins is therefore not subjected to hydrodesulfurization catalyst but to a less severe treatment wherein the mercaptans contained therein are reacted with diolefins contained therein to form dialkylsulfides (thioetherification) which are higher boiling and can be removed with the heavier naphtha. The thioetherification reactor can be either before or after a catalytic distillation hydrodesulfurization reactor so long as the hydrodesulfurization occurs in the stripping section of the catalytic distillation hydrodesulfurization reactor such that the lower boiling point materials are not contacted with the hydrodesulfurization catalyst.

THIOETHERIFICATION CATALYSTS

Catalysts which are useful in the mercaptan-diolefin reaction include the Group VIII metals. Generally the metals are deposited as the oxides on an alumina support.

A preferred catalyst for the thioetherification reaction in CD mode is 54 wt. % Ni on 8 to 14 mesh $Al_2O_3$ (alumina) spheres, supplied by Calcicat designated as E-475-SR. Typical physical and chemical properties of the catalyst as provided by the manufacturer are as follows:

TABLE I

| | |
|---|---|
| Designation | E-475-SR |
| Form | Sphere |
| Nominal size | 8 × 14 mesh |
| Ni wt. % | 54 |
| Support | alumina |

The hydrogen rate to the reactor must be sufficient to maintain the reaction, but kept below that which would cause flooding of the column which is understood to be the "effectuating amount of hydrogen " as that term is used herein. Generally the mole ratio of hydrogen to diolefins and acetylenes in the feed is at least 1.0 to 1.0 and preferably 2.0 to 1.0.

The thioetherification catalyst also catalyzes the selective hydrogenation of polyolefins contained within the light cracked naphtha and to a lesser degree the isomerization of some of the mono-olefins. Using the preferred Ni catalyst the relative rates of reaction for various compounds are in the order of from faster to slower:

(1) reaction of diolefins with mercaptans (2) hydrogenation of diolefins (3) isomerization of the mono-olefins (4) hydrogenation of the mono-olefins.

The reaction of interest is the reaction of the mercaptans with diolefins. In the presence of the catalyst the mercaptans will also react with mono-olefins. However, there is an excess of diolefins to mercaptans in the light cracked naphtha feed and the mercaptans preferentially react with them before reacting with the mono-olefins. The equation of interest which describes the reaction is:

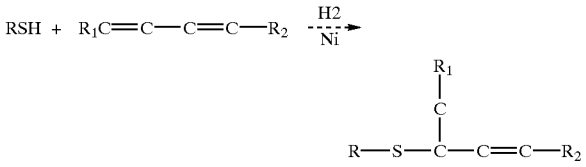

where $R_1$ or $R_2$ can be either an alkyl group or a hydrogen atom.

This may be compared to the HDS reaction described below which consumes hydrogen. The only hydrogen utilized in the removal of the mercaptans in the present invention is that necessary to keep the catalyst in the reduced "hydride" state. If there is concurrent hydrogenation of the dienes, then hydrogen will be consumed in that reaction.

HDS CATALYST

Catalysts which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts may additionally contain components from Group V and VIB metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams in the presence of hydrogen.

The properties of a typical hydrodesulfurization catalyst are shown in Table II below.

TABLE II

| | |
|---|---|
| Manufacture | Criterion Catalyst Co. |
| Designation | C-448 |
| Form | Tri-lobe Extrudate |
| Nominal size | 1.2 mm diameter |
| Metal, Wt. % | |
| Cobalt | 2–5% |
| Molybdenum | 5–20% |
| Support | Alumina |

The catalyst typically is in the form of extrudates having a diameter of 1/8, 1/16 or 1/32 inches and an L/D of 1.5 to 10. The catalyst also may be in the form of spheres having the same diameters. In their regular form they present too compact a mass and are preferably prepared in the form of a catalytic distillation structure. The catalytic distillation structure must be able to function as catalyst and as mass transfer medium.

CATALYTIC DISTILLATION STRUCTURE

When the catalysts are used within a distillation column reactor, they are preferably prepared in the form of a catalytic distillation structure. The catalytic distillation structure must be able to function as catalyst and as mass transfer medium. The catalyst is preferably supported and spaced within the column to act as a catalytic distillation structure. Catalytic distillation structures useful for this purpose are disclosed in U.S. Pat. Nos. 4,731,229, 5,073,236, 5,431,890 and 5,266,546 which are incorporated by reference.

The most preferred structure is that shown in U.S. Pat. No. 5,730,843 which is incorporated by reference. As disclosed therein the structure comprises a rigid frame made of two substantially vertical duplicate grids spaced apart and held rigid by a plurality of substantially horizontal rigid members and a plurality of substantially horizontal wire mesh tubes mounted to the grids to form a plurality of fluid pathways among the tubes. At least a portion of the wire mesh tubes contain a particulate catalytic material. The catalyst within the tubes provides a reaction zone where catalytic reactions may occur and the wire mesh provides mass transfer surfaces to effect a fractional distillation. The spacing elements provide for a variation of the catalyst density and loading and structural integrity and provides ample vapor and liquid throughput capability.

Referring now to the figures, specific embodiments of the process of the invention are shown.

In FIG. 1 the light naphtha and hydrogen are fed via flow line 101 to a standard single pass fixed bed thioetherification reactor 10 containing a bed 12 of thioetherification catalyst. In the reactor 10 the mercaptans in the naphtha react with the diolefins to produce dialkylsulfides. The effluent from the thioetherification reactor 10 is fed via flow line 102 to distillation column reactor 20 containing a bed 22 of hydrodesulfurization catalyst in the form of catalytic distillation structure. The hydrodesulfurization catalyst bed is located within the lower end or stripping section of the column. Within the bed 22 most of the remaining organic sulfur compounds are reacted with hydrogen fed through flow line 103 to form $H_2S$ which is removed with the overheads. These remaining organic-sulfur compounds will be heavily skewed toward those sulfur species that leave with the heavies fraction of the stream recovered below the catalyst bed.

The column is physically divided into separate sections by wall 29. The top section contains the hydrodesulfurization catalyst and is operated at about 250 psig or above to achieve a temperature in the stripping section of about 550° F.

The overheads from distillation column reactor 20 are taken via flow line 104 to partial condenser 30 where the condensible material is condensed. The effluent from the condenser 30 is passed to separator 40 wherein the uncondensed vapor is separated and removed via flow line 119. Liquid is removed from separator 40 via flow line 107 with light product stream containing $C_5$'s and $C_6$'s is taken via flow line 106. A portion of the liquid is returned to distillation column reactor 20 as reflux via flow line 105.

The bottoms from the distillation column reactor are bypassed around wall 29 via flow line 108 into about the middle of the lower section of the vessel 20 which is operated at a substantially lower pressure, i.e., 75 psig than the upper portion where an overheads product is taken via flow line 109 and totally condensed in condenser 60 and collector in vessel 70. A mid to light boiling range naphtha product containing $C_6$'s and $C_7$'s is taken via flow line 113. Since the lower boiling mercaptans have been reacted with diolefins in the thioetherification reactor 10 and the mid boiling range thiophenes have been removed in the distillation column reactor, the mid light naphtha product is relatively sulfur free.

The bottoms from the lower section are fed via flow line 110 to a standard fixed bed single pass hydrodesulfurization reactor 80 containing a bed hydrodesulfurization catalyst 82. Hydrogen is fed via flow line 117 which is reacted with the remainder of the organic sulfur compounds to provide a heavy light naphtha stream ($C_7$+) which is low in sulfur which is removed via flow line 116. The reactor 80 is operated at a higher severity (especially a higher temperature and pressure) than the distillation column reactor to polish or remove the remaining sulfur compounds. If desired all of the naphtha streams may be recombined to provide a gasoline blending stock which contains less that 50 wppm total sulfur content.

Figure 2:
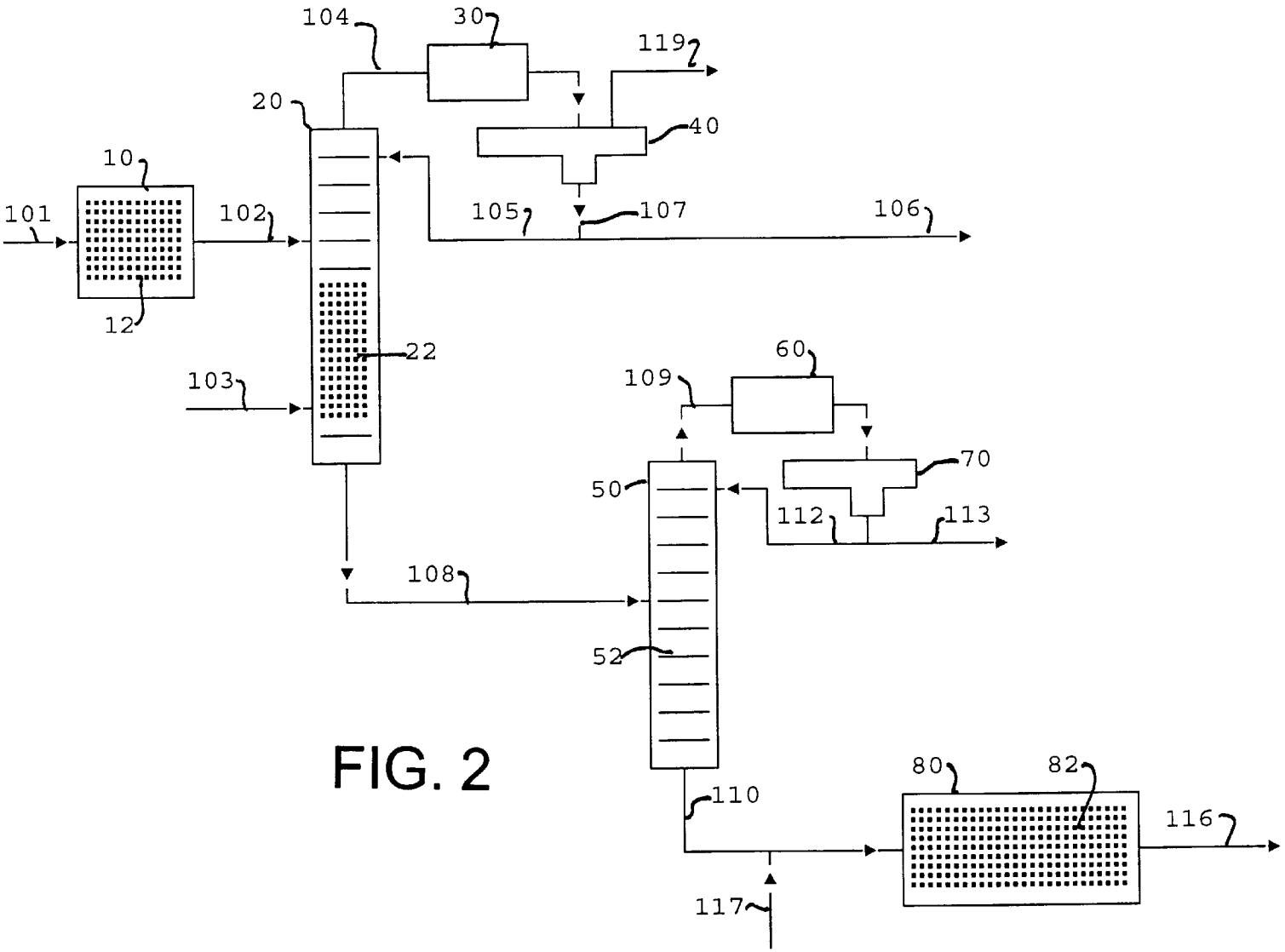
FIG. 2 is a flow diagram in schematic form of a second embodiment of the present invention.

Referring now to FIG. 2 there is shown an identical process as in FIG. 1 except the fractionator 50, corresponding to the lower section 19 of FIG. 1, containing standard distillation trays 52 is a separate vessel. The remainder of the components and flow is identical to FIG. 1 and the same index numbers are used. In FIG. 2 a process for the desulfurization of a light boiling range ($C_5$-350° F.) naphtha, preferably fluid catalytically cracked naphtha comprises first subjecting the naphtha to a thioetherification to react the diolefins contained therein with mercaptans contained therein to form sulfides in reactor 10. The product from the thioetherification is fed to a high pressure (>250 psig) distillation column reactor 20 along with hydrogen via line 103 and subjected to conditions to react most of the organic sulfur compounds contained therein, including the sulfides from the thioetherification, with hydrogen to form $H_2S$. The $H_2S$ and a light product stream ($C_5$'s and $C_6$'s) are removed as overheads via line 104. The bottoms from the distillation column reactor are fed to distillation column 50 operated at a pressure (<75 psig) substantially lower than the distillation column reactor. A mid light product stream ($C_6$–$C_7$'s) is separated as overheads via line 109 from a bottoms stream containing heavy lights product ($C_7$+) stream recovered via line 110. Note that overheads from the distillation column reactor is low in organic sulfur compounds because essentially all of mercaptans which boil in the $C_5$–$C_6$ range have reacted with diolefins to form sulfides in the thioetherification reactor 10. In addition, most of the organic sulfur compounds boiling in the mid light range have been removed in the distillation column reactor 20. The heavy lights products from the distillation column are then fed to a standard down flow single pass reactor 80 to react substantially all of the remaining organic sulfur compounds with hydrogen added via line 117 to form $H_2S$.

Figure 3:
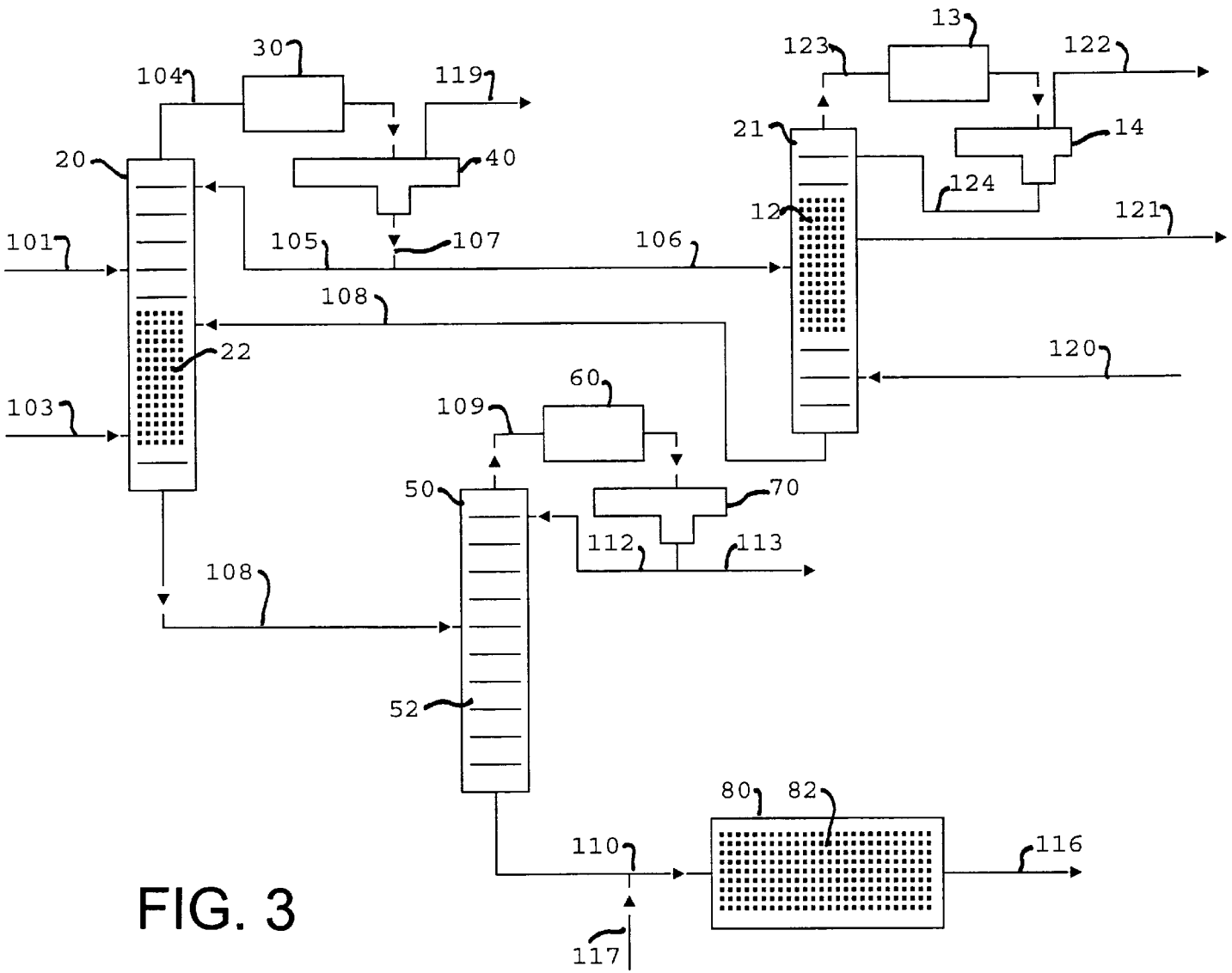
FIG. 3 is a flow diagram in schematic form of a third embodiment of the present invention.

Another embodiment of the process is shown in FIG. 3 wherein only the light naphtha is subjected to thioetherification in a second distillation column reactor 21. Again the same reference numerals are used to indicate similar pieces of equipment. The naphtha is fed via line 101 to a first distillation column reactor 20 containing a bed of hydrodesulfurization catalyst 22 in the lower stripping section. Hydrogen is fed below the bed via flow line 103. The light naphtha containing a small amount of thiophene is taken as overheads via flow line 104. The higher boiling naphtha is contacted with the hydrogen and catalyst in stripping section 22 where substantially all of the thiophene and most of the other organic sulfur compounds are reacted with hydrogen to form $H_2S$ which is removed in the overheads. The condensible material in the overheads is condensed in partial condenser 30 and collected in receiver/separator 40. Unreacted hydrogen, $H_2S$ and light ends are removed via flow line 119. Liquid is removed from the receiver/separator 40 via flow line 107. A portion of the condensed material is returned to distillation column reactor 20 as reflux via flow line 105. The first distillation column reactor is operated at a pressure of about 250 psig to maintain a temperature of about 550° F. in the stripping section.

The light naphtha is fed to a second distillation column reactor 21 containing a bed 12 of thioetherification catalyst via flow line 106. Hydrogen is fed to this reactor via flow line 120. Within the bed 12 the mercaptans react with the diolefins to form sulfides which are removed with the bottoms and returned to the first distillation column reactor 20. The overheads from the second distillation column reactor are taken via flow line 123 and the condensibles condensed in partial condenser 13. The overheads are then passed to receiver separator 14 where the uncondensible are separated and vented via flow line 122. All of the liquid from the receiver separator 14 are returned to the second distillation column reactor 21 as reflux. A side stream of light naphtha, $C_5$'s and $C_6$'s, is taken via flow line 121. The light naphtha has most of the mercaptans removed and thus contains very little if any sulfur.

The bottoms from the first distillation column reactor are fed to a splitter 50 (as heretofore described) containing standard distillation trays 52 wherein a mid range naphtha containing $C_6$'s and $C_7$'s is taken as overheads via flow line 109. The splitter is operated at substantially lower pressure, i.e., 75 psig, than the first distillation column reactor. The overheads are condensed in condenser 60 and collected in receiver 70. The $C_6$–$C_7$ product is taken via flow line 113. Because the thiophenes have been removed in the first distillation column, this product is very low in sulfur.

The bottoms from the splitter are fed via flow line 110 to a standard fixed bed single pass hydrodesulfurization reactor 80 containing a bed 82 of hydrodesulfurization catalyst. The reactor 80 is operated at a higher severity to react the remaining more refractory heavy-end sulfur compounds with hydrogen to form $H_2S$ which can be removed.

As in the first two cases, all of the naphtha streams may be recombined to provide a gasoline blending stock which contains less that 50 wppm total sulfur content.

In all of the above cases only the higher boiling naphtha is subjected to the most severe hydrodesulfurization conditions leaving the desirable olefins in the lighter portion.

The invention claimed is:

1. A process comprising:

a. feeding a naphtha stream containing diolefins and organic sulfur compounds comprising mercaptans to a reaction distillation zone;

b. concurrently in said reaction distillation zone:

i. contacting said naphtha feed with hydrogen in the presence of a hydrodesulfurization catalyst to produce a reaction mixture containing $H_2S$ and ii. fractionating said reaction mixture into a first overheads containing $H_2S$ and a naphtha fraction of less than $C_8$ and a first bottoms of a $C_6$+ naphtha fraction and organic sulfur compounds boiling in the range of the $C_6$+ naphtha fraction;

c. fractionating the first bottoms into a second overheads containing a $C_6$–$C_7$ naphtha fraction and a second bottoms containing a $C_7$+ naphtha fraction and sulfur compounds boiling in the range of the $C_7$+ naphtha fraction; and d. contacting the second bottoms with hydrogen in the presence of a hydrodesulfurization catalyst in a hydrodesulfurization reaction zone to further reduce the sulfur content.

2. The process according to claim 1 wherein said reaction zone is at a pressure of >250 psig and said hydrodesulfurization zone is at a pressure of >250 and a temperature >400° F.

3. The process according to claim 1 for the desulfurization of a $C_5$ to 350° F. boiling naphtha comprising the steps of:

(a) feeding at $C_5$ to 350° F. fluid naphtha containing olefins, diolefins, organic sulfur compounds comprising mercaptans to a reaction zone containing a thioetherification catalyst and reacting a portion of said mercaptans with a portion of said diolefins to form sulfides;

(b) feeding the effluent from said reaction zone and hydrogen to a reaction distillation zone having a bed of hydrodesulfurization catalyst:

(c) concurrently in said reaction distillation zone (i) contacting said hydrogen with said sulfides and said organic sulfur compounds in the presence of said hydrodesulfurization catalyst at a first severity to form a reaction mixture containing naphtha and hydrogen sulfide, (ii) fractionating said naphtha such that said hydrogen sulfide and a $C_5$-less than $C_8$ fraction are removed as a first overheads and a $C_6$-350° F. boiling fraction containing unreacted organic sulfur compounds as a first bottoms;

(d) feeding said first bottoms to a distillation zone where said first bottoms are fractionated such that a $C_6$–$C_7$ fraction is removed as a second overheads and a $C_7$+ boiling fraction containing unreacted organic sulfur compounds is removed as a second bottoms; and (e) feeding said second bottoms to a hydrodesulfurization reaction zone operated at a second severity greater than said reaction distillation zone such that a portion of said unreacted organic sulfur compounds is converted to hydrogen sulfide.

4. The process according to claim 3 wherein the operating pressure of said reaction distillation zone is adjusted such that the temperature within said reaction distillation zone is about 500–550° F.

5. The process according to claim 4 wherein the operating pressure of said reaction distillation zone is greater than 250 psig and the operating pressure of said distillation zone is less than 150 psig.

6. The process according to claim 3 wherein said naphtha is comprised of fluid cracked naphtha.

7. The process according to claim 1 for the desulfurization of a $C_5$ to 350° F. boiling naphtha comprising the steps of:

(a) feeding hydrogen and a $C_5$ to 350° F. naphtha containing olefins, diolefins and organic sulfur compounds comprising mercaptans to a first reaction distillation zone containing a bed hydrodesulfurization;

(b) concurrently in said first reaction distillation zone:

(i) reacting a portion of the organic sulfur compounds with hydrogen in the bed of hydrodesulfurization catalyst to form hydrogen sulfide, and (ii) fractionating said naphtha to separate a $C_5$-less than $C_8$ boiling range material containing unreacted mercaptans as first overheads along with said hydrogen sulfide and a $C_6$-350° F. boiling material as a first bottoms;

(c) feeding the first overheads to a second reaction distillation zone containing a bed of thioetherification catalyst;

(d) concurrently in said second reaction distillation zone:

(i) reacting a portion of said unreacted mercaptans with a portion of said diolefins to form a reaction mixture containing sulfides and $C_5$–$C_6$ naphtha, and (ii) fractionating the reaction mixture to separate out a second overheads containing a $C_5$–$C_6$ boiling material having reduced organic sulfur compounds and a second bottoms containing a $C_6$+ boiling material containing said sulfides and said organic sulfur compounds;

(e) feeding said second bottoms to said first reaction distillation zone where a portion of said sulfides are reacted with hydrogen in said bed of hydrodesulfurization catalyst to form hydrogen sulfide; and (f) feeding said first bottoms to a hydrodesulfurization reaction zone operated at a second severity greater than said first reaction distillation zone such that a portion of said unreacted other organic sulfur compounds is converted to hydrogen sulfide.

8. The process according to claim 7 wherein the operating pressure of said first reaction distillation zone is adjusted such that the temperature within said reaction distillation zone is about 500–550° F.

9. The process according to claim 8 wherein the operating pressure of said first reaction distillation zone is greater than 250 psig and the operating pressure of said distillation zone is less than 150 psig.

10. The process according to claim 7 wherein said naphtha is comprised of fluid cracked naphtha.

* * * * *